US011702772B2

(12) United States Patent
Aubrey et al.

(10) Patent No.: US 11,702,772 B2
(45) Date of Patent: Jul. 18, 2023

(54) WOOL FABRIC WITH STRETCH PROPERTIES AND GARMENTS MADE THEREFROM

(71) Applicant: Burlington Industries LLC, Greensboro, NC (US)

(72) Inventors: Thomas F. Aubrey, Raeford, NC (US); Sean P. Benninghoff, Raeford, NC (US); William J. DiIanni, Kernersville, NC (US); Michael N. Butterfield, Greensboro, NC (US)

(73) Assignee: Burlington Industries LLC, Greensboro, NC (US)

( * ) Notice: Subject to any disclaimer, the term of this patent is extended or adjusted under 35 U.S.C. 154(b) by 37 days.

(21) Appl. No.: 17/327,202

(22) Filed: May 21, 2021

(65) Prior Publication Data

US 2022/0372676 A1 Nov. 24, 2022

Related U.S. Application Data

(60) Provisional application No. 63/028,210, filed on May 21, 2020.

(51) Int. Cl.

| | |
|---|---|
| ***D03D 15/292*** | (2021.01) |
| ***D03D 15/233*** | (2021.01) |
| ***D03D 15/49*** | (2021.01) |
| ***D02G 3/04*** | (2006.01) |
| ***D03D 15/283*** | (2021.01) |
| *D03D 7/00* | (2006.01) |

(52) U.S. Cl.

CPC ..... *D03D 15/233* (2021.01); *D02G 3/045* (2013.01); *D03D 15/283* (2021.01); *D03D 15/292* (2021.01); *D03D 15/49* (2021.01); *D10B 2331/04* (2013.01)

(58) Field of Classification Search

CPC .. D03D 15/233; D03D 15/283; D03D 15/292; D03D 15/49; D02G 3/045; D10B 2331/04

See application file for complete search history.

(56) References Cited

U.S. PATENT DOCUMENTS

| | | | | |
|---|---|---|---|---|
| 9,878,185 | B2 * | 1/2018 | Underwood | A41D 1/02 |
| 9,908,987 | B2 * | 3/2018 | Foss | C08J 3/128 |
| 10,508,188 | B2 * | 12/2019 | Foss | C08J 3/128 |
| 10,617,225 | B1 * | 4/2020 | Wildeman | A47C 27/008 |
| 2005/0176323 | A1 * | 8/2005 | Minato | D03D 15/46 139/416 |

(Continued)

FOREIGN PATENT DOCUMENTS

| | | |
|---|---|---|
| WO | WO2015/123419 A1 | 8/2015 |
| WO | WO2019/110960 A1 | 6/2019 |

OTHER PUBLICATIONS

International Search Report Corresponding to Application No. PCT/US21/33638 dated Aug. 16, 2021.

*Primary Examiner* — Robert H Muromoto, Jr.

(74) *Attorney, Agent, or Firm* — Dority & Manning, P.A.

(57) ABSTRACT

Wool fabrics are disclosed that have improved stretch properties. The wool fabrics can be used in numerous and diverse applications, such as to make uniforms. The fabric can be designed to have greater than 15%, such as greater than about 20% stretch in one or more directions, such as in the fill direction. In one aspect, longer wool fibers are used in the fabric in order to increase durability.

20 Claims, 1 Drawing Sheet

(56) References Cited

U.S. PATENT DOCUMENTS

| | | | | |
|---|---|---|---|---|
| 2008/0138599 | A1* | 6/2008 | Gao | D01F 6/30 428/221 |
| 2015/0044449 | A1* | 2/2015 | Foss | C08J 3/128 428/221 |
| 2015/0176164 | A1* | 6/2015 | Lucas | B32B 5/028 442/364 |
| 2016/0208419 | A1* | 7/2016 | Tharpe, Jr. | D02G 3/32 |
| 2018/0002839 | A1* | 1/2018 | Liao | D06P 5/2066 |
| 2022/0002922 | A1* | 1/2022 | Hah | D04H 1/4291 |

* cited by examiner

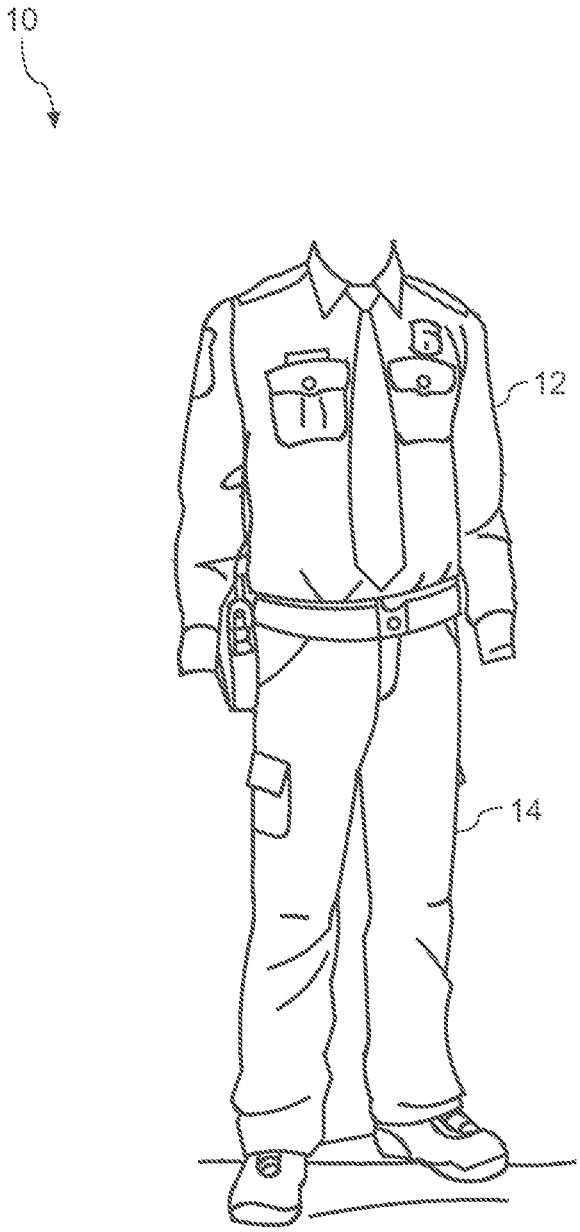
10
12
14

WOOL FABRIC WITH STRETCH PROPERTIES AND GARMENTS MADE THEREFROM

RELATED APPLICATONS

The present application is based on and claims priority to U.S. Provisional Patent Application Ser. No. 63,028,210, filed on May 21, 2020, which is incorporated herein by reference.

BACKGROUND

Uniforms worn by public safety officers and military personnel serve various functions. The uniforms, for instance, readily identify the wearer as someone who is there for public safety and to preserve the peace. The general public can easily recognize uniforms for seeking safety or medical attention. Uniforms also represent authority, which instills pride in the wearer and garners respect from the wearer's peers.

Uniforms, such as public safety uniforms, should also be functional and provide protection to the wearer. In addition to providing protection, the uniform should be highly flexible, provide breathability, and should encumber the wearer as little as possible, especially when the wearer is involved in physical activity.

In the past, public safety uniforms and uniforms worn by the military have incorporated wool fibers and wool yarns. Wool can provide numerous and various advantages. For example, wool is wrinkle resistant, retains its shape and is shrink resistant. In addition, wool is durable and tear resistant. Further, wool repels water drops and absorbs water vapor, and is comfortable to wear in all seasons. Wool also possesses inherent fire resistance. Wool fibers, for instance, are self-extinguishing and will not support combustion, which can be especially advantageous when worn by public safety officials, such as fire fighters, police, and those in the military.

Although wool does provide some inherent stretch properties, those skilled in the art have attempted to incorporate greater stretch into uniforms made from wool. For example, in the past, wool has been combined with elastic fibers, such as monofilament spandex fibers. Although good stretch characteristics have been incorporated into fabrics made in the past, further improvements are still needed. More particularly, improvements are needed in incorporating greater stretch into wool fabrics so that the fabrics are not only more comfortable to wear, but allow the wearer to engage in physical activity without being encumbered by the garment.

SUMMARY

In general, the present disclosure is directed to a wool fabric with improved stretch properties. The present disclosure is also directed to garments made from the fabric. The garments, for instance, can include public safety uniforms, such as uniforms worn by the police, other peace officers, rangers and other park officials, military personnel, first responders including firefighters, and the like. The fabric of the present disclosure is also well suited to producing athletic uniforms and industrial work wear.

In one aspect, the fabric of the present disclosure includes warp yarn woven with fill yarns. The warp yarns comprise spun yarns containing wool fibers. In accordance with the present disclosure, all of the fill yarns can comprise crimped bicomponent filament yarns. Each bicomponent filament can include a first polyester portion and a second polyester portion positioned in the filament in a side by side relationship. For example, the crimp bicomponent filament yarns, after being heat set, can have a crimped contraction of from about 20% to about 80%. In accordance with the present disclosure, the fabric exhibits a stretch of at least 15%, such as at least 18%, such as at least 20% in the fill direction when tested according to ASTM Test D3107.

In one embodiment, the first polyester portion of the bicomponent filament yarns can comprise a polyethylene terephthalate polymer. The second polyester potion, on the other hand, can comprise a poly (trimethylene terephthalate). The bicomponent filament yarns can comprise continuous filaments. The yarns can also be textured. In one aspect, the yarns can have a denier of from about 50 to about 350, such as from about 100 to about 200.

The spun yarns containing the wool fibers can also contain synthetic polymer fibers. For instance, the spun yarns can contain wool fibers combined with polyester fibers. The wool fibers can make up from about 15% to about 85% by weight of the yarn, such as from about 25% to about 75% by weight of the yarn, such as from about 45% to about 55% by weight of the yarn. The remainder of the yarn can comprise polyester fibers. The spun yarns can comprise plied yarns or single spun yarns. The wool fibers incorporated into the spun yarns can have an average fiber length of greater than about 3 inches and less than about 5 inches. The wool fibers can have a diameter of greater than about 18 microns, such as from about 18 microns to about 25 microns. Wool fibers can be contained in the fabric generally in an amount from about 20% to about 60% by weight. The fabric can have a basis weight of from about 4.5 osy to about 12 osy. Such as from about 5.5 osy to about 10 osy.

In another aspect, the present disclosure is directed to a fabric with stretch properties comprising warp yarns woven with fill yarns. The warp yarns can comprise spun yarns containing wool fibers. The wool fibers can have an average fiber length of greater than about 3 inches. The fabric can further contain crimped bicomponent filament yarns that provide the stretch properties. Each bicomponent filament can include a first polyester portion and a second polyester portion positioned in the filament in a side by side relationship. The fabric can exhibit a stretch of at least 15%, such as at least 18% in the fill and/or in the warp direction when tested according to ASTM Test D3107.

The present disclosure is also directed to garments made from fabrics as described above. The garment, for instance, can comprise a uniform. In producing the uniform, the fabric can be piece dyed. Alternatively, the fibers contained within the fabric can be top dyed. In still another aspect, the yarns contained within the fabric can be packaged dyed. Each of the above dying techniques can be used alone or in combination when forming the garments. The garment made in accordance with the present disclosure can be a uniform, such as a police uniform. The garment can include a shirt and a pair of pants that are the same color. Garments made in accordance with the present disclosure are well suited for use by all different types of public safety personnel, industrial workers, athletes, and the like.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which:

FIG. 1 is a perspective view of one embodiment of a uniform that may be made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only and is not intended as limiting the broader aspects of the present disclosure.

In general, the present disclosure is directed to a wool fabric having excellent stretch characteristics in at least one direction. The wool fabric can be used to produce numerous different types of clothing articles and garments. The wool fabric with stretch properties is particularly well suited to producing uniforms for public safety personnel, first responders, such as firemen, military personnel, and the like. The stretchable wool fabric is also well suited for producing industrial workwear. The fabric possesses not only all of the advantages of a wool fabric, but also has form fitting properties that allow the fabric to stretch when the wearer is involved in physical activity or when bending or kneeling.

In general, the fabric of the present disclosure is formed by combining spun yarns containing wool with crimped multi-component filament yarns. Each filament in the crimped multi-component filament yarns is formed from at least two different polymers that occupy different spaces within the filament. Two polymers are selected that have different shrink characteristics, causing the filament to crimp and provide stretch properties. In one aspect of the present disclosure, the crimped multi-component filament yarns are positioned at certain locations within the fabric for providing stretch properties where desired. For example, in one particular embodiment, the crimped multi-component filament yarns can be placed in the fill direction for providing stretch properties in the fill direction.

As described above, the fabric of the present disclosure also includes spun yarns containing wool. Significant amounts of wool fibers are incorporated into the fabric for providing all of the benefits and advantages of a wool fabric, including fire resistance, anti-wrinkling properties, comfort, and breathability. In one aspect, relatively long wool fibers are incorporated into the fabric. The longer wool fibers can provide various advantages and benefits. The longer wool fibers, for instance, can dramatically increase durability.

Fabrics made in accordance with the present disclosure can be knitted or woven, although woven fabrics are better suited for use in many garment applications. The woven fabric can include warp yarns woven together with fill yarns. The warp yarns extend in the warp direction or length direction. The fill yarns, on the other hand, extend in the fill direction or the width direction. Spun yarns containing wool fibers can extend only in the warp direction, only in the fill direction, or can extend in both the warp and fill direction. Similarly, the crimped multi-component filament yarns can extend only in the fill direction, only in the warp direction, or can extend both in the warp and fill directions. The crimped multi-component filament yarns are placed in the fabric in the direction in which stretch properties are desired.

As described above, the spun yarns incorporated into the fabric contain wool fibers. The spun yarns can contain only wool fibers or can contain wool fibers combined with other fibers. The other fibers can be synthetic or natural fibers. For example, the spun yarns can contain wool fibers combined with polyester fibers, nylon fibers, cotton fibers, regenerated cellulous fibers such as rayon fibers, acrylic fibers, and the like.

In one particular aspect, the spun yarns contained wool fibers combined with polyester fibers. The polyester fibers can be staple polyester fibers and can be contained in the spun yarns in an amount greater than about 15% by weight, such as in an amount greater than about 25% by weight, such as in an amount greater than about 35% by weight, such as in an amount greater than about 45% by weight, such as in an amount greater than about 55% by weight. The polyester staple fibers are generally contained in the spun yarns in an amount less than about 85% by weight, such as in an amount less than about 75% by weight, such as in an amount less than about 65% by weight, such as in an amount less than about 55% by weight. The remainder of the spun yarns can comprise the wool fibers. For example, the wool fibers can also be present in the spun yarn in an amount greater than about 15% by weight, such as in an amount greater than about 25% by weight, such as in an amount greater than about 35% by weight, such as in an amount greater than about 45% by weight, such as in an amount greater than about 55% by weight, and generally in an amount less than 85% by weight (when combined with other fibers such as polyester fibers), such as in an amount less than about 75% by weight, such as in an amount less 65% by weight, such as in an amount less than about 55% by weight, such as in an amount less than about 50% by weight. When forming the spun yarns, the wool fibers and polyester fibers can form an intimate blend within each yarn.

Alternatively, however, the spun yarns can only contain wool fibers or may contain wool fibers combined with one or more of the other fiber types described above. In still another embodiment, the fabric may contain multiple different types of spun yarns. For example, the fabric can include spun yarns made exclusively from wool fibers in combination with spun yarns made from a blend of wool fibers and polyester fibers. In still another embodiment, different spun yarns can be used in which the amount of wool fibers in relation to the amount of polyester fibers can vary between two different types of yarns incorporated into the fabric.

Although any suitable wool fiber can be used in accordance with the present disclosure, in one aspect, wool fibers are incorporated into the fabric that have a relatively long length. For example, the wool fibers can have a length of greater than about 2.5 inches, such as greater than about 2.75 inches, such as greater than about 3 inches, such as greater than about 3.25 inches, such as greater than about 3.5 inches. The wool fibers generally have an average length of less than about 5 inches, such as less than about 4.5 inches, such as less than about 4 inches. The wool fibers can also have a relatively large diameter. For instance, the diameter of the wool fibers can be greater than about 18 microns, such as greater than about 19 microns, such as greater than about 20 microns, such as greater than about 21 microns. The average diameter of the wool fibers can generally be less than about 25 microns, such as less than about 23 microns, such as less than about 22 microns. Incorporating longer wool fibers and/or fibers having a relatively large diameter can provide challenges in forming the yarn and in weaving the yarns into the fabric. According to the present disclosure, however, it was discovered that the above described fibers can provide numerous advantages. The longer wool fibers, for instance, can significantly increase durability without sacrificing comfort.

The spun yarns incorporated into the fabric can be single spun yarns or can be plied yarns. Alternatively, the fabric can contain both single spun yarns and plied yarns. In one aspect, the fabric contains plied yarns at least in one direction, such as in the warp direction or in the fill direction. For example, in one aspect, the fabric is formed from plied spun yarns in the warp direction. The present inventors discovered that plied yarns inhibit the formation of streaks or striations in the fabric in comparison to the use of single spun yarns.

The size of the spun yarns can vary depending upon the particular application and the desired result. For example, the size of the spun yarns can depend upon the desired overall weight of the fabric, the type of crimped multi-component multifilament yarns that are used, the type of garment being formed, and the like. In one aspect, when using single yarns, the yarn size can be 1/24, 1/26, 1/28, 1/30, 1/32, 1/34, 1/36, 1/38, and/or 1/40. When using plied yarns, on the other hand the size can be 2/40, 2/44, 2/48, 2/52, 2/56, 2/60, 2/64, 2/68, 2/72, or 2/76 including all intervening sizes therebetween. The above sizes are based on worsted count (560 yards/lb).

In addition to one or more types of spun yarns, fabrics made according to the present disclosure also contain yarns that provide stretch properties. More particularly, the fabric contains crimped multi-component filament yarns which have been found to provide significant stretch characteristics when incorporated into the fabric along a particular direction. The spun yarns containing the wool fibers, on the other hand, can counteract the stretch characteristics of the multi-component filament yarns for providing integrity and stability.

In one embodiment, the crimped multi-component filament yarns include bicomponent filaments containing two different polyester polymers. The polyester polymers can be positioned in the filament in a side by side relationship. The two different polyester polymers can have different shrink characteristics that incorporate stretch characteristics into the filaments when heat set.

The polyester bicomponent filaments include poly(ethylene terephthalate) and poly(trimethylene terephthalate) in a weight ratio of about 30/70 to about 70/30, and have an after-heat-set crimp contraction value from about 20% to about 80%, preferably about 30% to about 60%. Various comonomers can be incorporated into the polyesters of the bicomponent filament in minor amounts, provided. Such comonomers do not have an adverse effect on the amount of fiber crimp. Examples include linear, cyclic, and branched aliphatic dicarboxylic acids (and their diesters) having 4-12 carbon atoms; aromatic dicarboxylic acids (and their esters) having 8-12 carbon atoms (for example isophthalic acid, 2,6-naphthalenedicarboxylic acid, and 5-sodium-stilfoisophthalic acid); and linear, cyclic, and branched aliphatic diols having 3-8 carbon atoms (for example 1,3-propane diol, 1,2-propanediol, 1,4-butanediol, 3-methyl-1,5-pentanediol, 2,2-dimethyl-1,3-propanediol, 2-methyl-1,3-propanediol, and 1,4-cyclohexanediol). Isophthalic acid, pentanedioic acid, 5-sodium-sulfoisophthalic acid, hex anedioic acid, 1,3-propane diol, and 1,4-butanediol are preferred. The polyesters can also have incorporated therein additives, such as titanium dioxide.

The linear density of the crimped bicomponent filament yarns can vary depending upon the particular application. The denier of the crimped bicomponent filament yarns, for instance, can generally be greater than about 50, such as greater than about 75, such as greater than about 100, such as greater than about 125, such as greater than about 140, and generally less than about 800, such as less than about 350, such as less than about 250, such as less than about 200, such as less than about 175, such as less than about 160. Each yarn can contain a plurality of filaments. For instance, each yarn can contain greater than about 10 filaments, such as greater than about 25 filaments, such as greater than about 40 filaments, such as greater than about 60 filaments, such as greater than about 70 filaments, such as greater than about 80 filaments, and generally less than about 200 filaments, such as less than about 150 filaments, such as less than about 120 filaments. In one aspect, the crimped bicomponent filament yarns can have greater than about 0.75 denier per filament, such as greater than about 1 denier per filament, such as greater than about 1.3 denier per filament, and generally less than about 2.5 denier per filament, such as less than about 2 denier per filament, such as less than about 1.75 denier per filament, such as less than abut 1.6 denier per filament.

In some embodiments the polyester bicomponent filament yarns are not twisted or entangled combinations of bicomponent filaments with other, for example, monocomponent or staple, fibers. In other words, in these embodiments, the bicomponent filament yarns may be woven separately from the other yarns in the fabric in order to avoid the expense of an additional step, to obtain high stretch and recovery properties, and to give high fabric surface smoothness.

In other embodiments the polyester bicomponent filaments may be twisted, entangled, or core-spun with other fibers or filaments to provide additional beneficial properties. These properties include reducing exposure of the bicomponent filament and providing different textures to the fabric. In these embodiments, a multi-component yarn may be prepared which includes polyester bicomponent filaments in addition to another fiber or filament which may be staple, continuous filament, and optionally textured fibers. These other fibers or filaments include relatively non-elastic yarns, also sometimes referred to as hard yarns such as cotton, polyester, nylon, rayon and wool, as well as elastomeric yarns such as rubber filament, bicomponent and elastoester, lastol and spandex.

Multi-component yarns may also include covered yarns where one fiber is surrounded by, twisted with, or intermingled with another fiber or yarn. Covered yarns that include elastomeric fibers and hard yarns are also termed "composite yarns." When an elastomeric fiber is used, the hard-yarn covering serves to protect the elastomeric fibers from abrasion during weaving processes. Such abrasion can result in breaks in the elastomeric fiber with consequential process interruptions and undesired fabric non-uniformities. Further, the covering helps to stabilize the elastomeric fiber elastic behavior, so that the composite yarn elongation can be more uniformly controlled during weaving processes than would be possible with bare elastomeric fibers.

There are multiple types of composite yarns, including: (a) single wrapping of the one fiber with a different fiber; (b) double wrapping of one fiber with another fiber, (c) continuously covering (i.e., core spinning) one fiber with staple fibers, followed by twisting during spinning; (d) intermingling and entangling two or more fibers with an air jet, and (e) twisting two or more different fibers or yarns together. One example of a composite yarn is a corespun yarn. A "corespun yarn" includes of a separable core surrounded by a spun fiber sheath. Elastomeric corespun yarns are produced by introducing an elastomeric filament to the front drafting roller of a spinning frame where it is covered by staple fibers.

The amount of stretch provided by the crimped bicomponent filament yarns can be measured as an after-heat-set crimp contraction value. After-heat-set contraction values can be measured as follows. A sample of the bicomponent polyester filament to be used is formed into a skein of 5000+/−5 total denier (5550 dtex) with a skein reel at a tension of about 0.1 gpd (0.09 dN/tex). The skein is conditioned at 70+/−2° F. (21+/−1° C.) and 65+/−2% relative humidity for a minimum of 16 hours. The skein is hung substantially vertically from a stand, a 1.5 mg/den (1.35 mg/dtex) weight (e.g. 7.5 g for a 5550 dtex skein) is hung on the bottom of the skein, the weighted skein is allowed to come to an equilibrium length, and the length of the skein is measured to within 1 mm and recorded as "Cb". The 1.35 mg/dtex weight is left on the skein for the duration of the test. Next, a 500 g weight (100 mg/d; 90 mg/dtex) is hung from the bottom of the skein, and the length of the skein is measured to within 1 mm and recorded as "Lb". Crimp contraction value (percent) (before heat-setting, as described below for this test), "CCb", is calculated according to the formula $$CCb=100\times(Lb-Cb),\ Lb$$

The 500 g weight is removed and the skein is then hung on a rack and heat-set, with the 1.35 mg/dtex weight still in place, in an oven for 5 minutes at about 225° F. (107° C.), after which the rack and skein were removed from the oven and conditioned as above for two hours. This step is designed to simulate commercial dry heat-setting, which is one way to develop the final crimp in the bicomponent fiber. The length of the skein is measured as above, and its length is recorded as "Ca". The 500 g weight is again hung from the skein, and the skein length is measured as above and recorded as "La'. The after heat-set crimp contraction value (%), "CCa", is calculated according to the formula $$CCa=100\times(La-Ca)La$$

As described above, the placement of the spun yarns in the woven fabric of the present disclosure in relation to the crimped bicomponent filament yarns can depend on various factors including the amount of stretch desired and the direction in which the stretch is desired. The spun yarns, on the other hand, can be incorporated for controlling the stretch properties and for providing all of the benefits and advantages to using wool fibers. In one particular aspect, the fabric is formed such that all of the warp yarns are spun yarns. In this manner, the crimped bicomponent filament yarns only extend in the fill direction. For example, greater than 50%, such as greater than 60%, such as greater than 70%, such as greater than 80%, such as greater than 90% of the yarns in the fill direction can be crimped bicomponent filament yarns. In one particular embodiment, the warp yarns are all spun yarns containing wool fibers and the fill yarns are all crimped bicomponent filament yarns.

In one aspect, all of the warp yarns can comprise spun yarns while the fill yarns can comprise a combination of crimped, bicomponent multifilament yarns and a second fill yarn. For example, a plurality of crimped bicomponent filament yarns can be grouped together and separated by one or second fill yarns. The second fill yarns can be spun yarns or filament yarns. The spun yarns can be as described above with respect to the warp yarns. Alternatively, the second fill yarns can be filament yarns, such as multifilament yarns. In one aspect, the second fill yarns can be texturized polyester multifilament yarns. The second fill yarns can have a size or denier that substantially matches the size or denier of the crimped bicomponent filament yarns. Any suitable pattern can be incorporated into the fill direction. For example, from about 2 to about 20 crimped bicomponent multifilament yarns, such as from about 4 to about 12 crimped bicomponent filament yarns can be separated by from about 1 to about 10 second fill yarns, such as from about 1 to about 5 second fill yarns. In one particular embodiment, the yarn pattern in the fill direction can be 3 to 10 crimped bicomponent filament yarns separated by 1 spun yarn or can be 1 to 2 crimped bicomponent filament yarns separated by 1 multifilament yarn.

In still another embodiment, crimped bicomponent filament yarns can extend in both the fill direction and the warp direction for providing a fabric with duel stretch properties. For example, the ratio between the spun yarns and the crimped bicomponent filament yarns in the warp direction and/or the fill direction can be from about 20:1 to about 1:20. In one aspect, the ratio between the spun yarns and the crimped bicomponent filament yarns in the warp direction the fill direction can be from about 8:1 to about 1:8, such as from about 4:1 to about 1:4, such as from about 2:1 to about 1:2.

Once the fabric is formed in accordance with the present disclosure, the fabric can contain wool fibers in an amount generally greater than about 20% by weight, such as in an amount greater than about 25% by weight, such as in an amount greater than about 30% by weight, such as in an amount greater than about 35% by weight, such as in an amount greater than about 40% by weight, and generally in an amount less than about 60% by weight, such as in an amount less than about 55% by weight, such as in an amount less than about 50% by weight, such as in an amount less than about 45% by weight. The crimped bicomponent filament yarns can be present in the fabric in an amount greater than about 20% by weight, such as in an amount greater than about 30% by weight, such as in an amount greater than about 40% by weight, and generally in an amount less than about 60% by weight, such as in an amount less than about 50% by weight, such as in an amount less than about 40% by weight.

When producing a woven fabric in accordance with the present disclosure, the fabric can have any suitable weave. For instance, the fabric can have a plain weave, a twill weave, or a rip stop weave. In one embodiment, the fabric can also be made with a herringbone weave. Twill weaves that can be used include 1 by 2 twill weaves, 1 by 3 twill weaves, 1 by 4 twill weaves, 2 by 1 twill weaves, and the like.

The yarn density of fabrics made according to the present disclosure can vary depending upon the size and type of yarns used, the desired basis weight of the fabric, and other various factors. In one aspect, the fabric can have from about 50 to about 190 ends per inch and from about 35 to about 95 picks per inch. For instance, the fabric can include greater than about 80 ends per inch, such as greater than about 100 ends per inch, such as greater than about 120 ends per inch, such as greater than about 130 ends per inch, and generally less than about 160 ends per inch, such as less than about 140 ends per inch. The fabric can have greater than about 40 picks per inch, such as greater than about 50 picks per inch, such as greater than about 60 picks per inch, such as greater than about 70 picks per inch, such as greater than about 80 picks per inch, and generally less than about 95 picks per inch, such as less than about 90 picks per inch, such as less than about 85 picks per inch.

The fabrics constructed in accordance with the present disclosure can be used to construct numerous different types of products for use in various applications. In one embodiment, for instance, the fabrics can be used to produce garments including any suitable clothing articles. Due to the combination of comfort, durability and stretch, fabrics of the present disclosure are particularly well suited for producing uniforms. For example, the fabrics can be used to produce uniforms for public safety personnel, park rangers, military personnel, security personnel, athletes, and the like. Garments made according to the present disclosure may include shirts, pants, bib overalls, socks and other leg wear, gloves, scarves, hats, and the like.

For instance, in one embodiment as shown in FIG. 1, the fabric can be used to produce a police uniform 10. As shown, the police uniform 10 can include a shirt 12 and trousers or pants 14. Of particular advantage, the fabric of the present disclosure is substantially wrinkle free, maintains its form, and can include permanent press lines.

Many uniforms that are produced have strict color performance guidelines. For instance, many police uniforms as shown in FIG. 1 are dyed a distinctive blue color, such as a dark blue. In addition, the color of the shirt 12 should, in many embodiments, match the color of the pants 14. Fabrics made according to the present disclosure not only have an excellent balance of physical properties, but are also amenable to various different dying processes that allow for strict color control.

For example, in one aspect, fabrics made according to the present disclosure can be piece dyed when producing garments. During piece dying, the woven fabric is fed through a dying process. Of particular advantage, fabrics can be piece dyed according to the present disclosure and have a uniform and consistent shade of color even though the fabric contains different types of yarns.

Alternatively, the yarns can first be dyed and then woven to form the fabric. For instance, fabrics can be made according to the present disclosure containing yarns that have been packaged dyed, which includes doped dyed yarns.

In still another aspect, the fibers incorporated into the fabric of the present disclosure can first be dyed prior to forming the yarns. The fibers, for instance, can be top dyed, which includes producer dyed fibers.

In addition, all of the above dying techniques can be combined together in forming fabrics. For example, in one embodiment, the fill yarns can be package dyed, while the warp yarns can include fibers that have been top dyed. In still another embodiment, the warp yarns can include fibers that have been top dyed and the woven fabric can be later piece dyed.

As described above, the use of the crimped multicomponent filament yarns in combination with the spun yarns provides an excellent balance of comfort, durability and stretch properties. In fact, the use of the crimped multicomponent filament yarns can supply the fabric with significant stretch properties in one or two directions. In one embodiment, for instance, the crimped multicomponent filament yarns can be incorporated into the fill direction only and can provide the fill direction with a stretch of at least 15%, such as at least 18%, such as least 20%, such as least 22%, such as least 25%, and generally less than about 40% when tested according to ASTM Test D3107. In this embodiment, the warp direction can have a stretch of less than about 5%, such as less than about 4%, such as less than about 3%.

Alternatively, the crimped multicomponent filament yarns can be incorporated in the warp direction or in both the warp direction and the fill direction. Similar to the fill direction, for instance, the warp direction can have a stretch of at least 15%, such as least 18%, such as at least 20%, such as at least 23%, such as at least 25%, and generally less than about 40% when tested according to ASTM Test D3107.

The present disclosure may be better understood with reference to the following examples.

EXAMPLE

Three different fabrics were made in accordance with the present disclosure and tested for various properties including Stretch.

The following fabrics were tested.

Sample No. 1: Sample No. 1 contained 71% by weight polyester and 29% by weight wool. The fabric had a basis weight of 6.15 osy. The fabric was dyed a navy color. The warp yarns contained in the fabric were spun yarns containing 55% wool fibers and 45% polyester fibers. The wool fibers had a length from about 3.5 inches to about 4 inches. The fill yarns included crimped bicomponent multifilament yarns as described above in combination with polyester texturized multifilament yarns in a 1 to 1 relationship. The yarns alternated in the fill direction. The fabric had a 2×1 twill weave.

Sample No. 2: Sample No. 2 was very similar in construction to Sample No. 1. Sample No. 2, however, had a twill elastique weave. The fabric contained 75% by weight polyester and 25% by weight wool. The fabric had a basis weight of 8.40 osy. This fabric was dyed a pink tan color.

Sample No. 3: Sample No. 3 contained 69% by weight polyester and 31% by weight wool. The fabric contained the same spun yarns as described above with respect to Sample No. 1. The fill yarns contained in the fabric were all made from the crimped bicomponent multifilament yarns. The fabric was dyed a navy color and had a 3×1 twill weave. The fabric had a basis weight of 7.95 osy.

In the above samples, the crimped bicomponent multifilament yarns had a denier of 150. The polyester texturized, multifilament yarns also had a denier of 150. The spun yarns had a count of 2/60.

Stretch was tested according to ASTM Test D3107 and breaking strength was tested according to ASTM Test D5034. In addition to the above, the fabric samples also displayed little to no shrinkage even after 25 laundry cycles.

| | Sample No. 1 | Sample No. 2 | Sample No. 3 |
|---|---|---|---|
| Stretch (%) Warp | 1.60 | 1.60 | 2.00 |
| Fill | 23.60 | 20.00 | 23.60 |
| Recovery (%) Warp | 100.00 | 99.80 | 100.00 |
| Fill | 99.20 | 99.00 | 100.00 |
| Breaking Strength Warp | 68.56 | 180.74 | 203.40 |
| Fill | 62.31 | 242.20 | 174.90 |

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A fabric with stretch properties comprising:

warp yarns woven with fill yarns, the warp yarns comprising spun yarns containing wool fibers and polyester fibers, wherein all of the warp yarns comprise spun yarns, wherein the spun yarns contain wool fibers in amount from about 15% to about 85% by weight and contain polyester fibers in an amount from about 15% to about 85% by weight, all of the fill yarns comprising crimped bicomponent filament yarns, each bicomponent filament including a first polyester portion and a second polyester portion positioned in the filament in a side by side relationship, the fabric exhibiting a stretch of at least 15% in the fill direction when tested according to ASTM Test D3107.

2. A fabric as defined in claim 1, wherein the crimped bicomponent filament yarns after heat set have a crimped contraction of from about 20% to about 80%.

3. A fabric as defined in claim 1, wherein the first polyester portion comprises polyethylene terephthalate and the second polyester portion comprises poly(trimethylene terephthalate), wherein the weight ratio of the polyethylene terephthalate to the poly(trimethylene terephthalate) is from about 30/70 to about 70/30.

4. A fabric as defined in claim 1, wherein the bicomponent filament yarns comprise continuous filaments and wherein the yarns are textured, the yarns having a denier from about 50 to about 350.

5. A fabric as defined in claim 1, wherein the fabric has a basis weight of from about 4.5 osy to about 12 osy.

6. A fabric as defined in claim 1, wherein the wool fibers comprise wool staple fibers having an average fiber length of greater than about 3 inches and less than about 5 inches.

7. A fabric has defined in claim 1, wherein the wool fibers have a diameter of greater than about 18 μm.

8. A fabric as defined in claim 1, wherein the spun yarns contain wool fibers and polyester fibers.

9. A fabric as defined in claim 1, wherein the spun yarns comprise plied yarns.

10. A fabric as defined in claim 1, wherein the spun yarns comprise single spun yarns.

11. A fabric as defined in claim 1, wherein the spun yarns contain wool fibers in amount from about 25% to about 75% by weight and contain polyester fibers in an amount from about 25% to about 75% by weight.

12. A fabric as defined in claim 1, wherein the spun yarns contain wool fibers in amount from about 45% to about 55% by weight and contain polyester fibers in an amount from about 45% to about 55% by weight.

13. A fabric as defined in claim 1, wherein the fabric contains the wool fibers in an amount from about 20% to about 60% by weight.

14. A fabric as defined in claim 1, wherein the fabric contains the wool fibers in an amount from about 25% to about 45% by weight.

15. A fabric with stretch properties comprising:

warp yarns woven with fill yarns, the warp yarns comprising spun yarns containing wool fibers, the wool fibers having on average fiber length of greater than about 3 inches, the fabric further containing crimped bicomponent filament yarns, each bicomponent filament including a first polyester portion and a second polyester portion positioned in the filament in a side-by-side relationship, the fabric exhibiting a stretch of at least 15% in the fill direction when tested according to ASTM Test D3107.

16. A fabric as defined in claim 15, wherein all of the fill yarns comprise the bicomponent filament yarns, wherein the bicomponent filament yarns comprise continuous filaments and wherein the yarns are textured, the yarns having a denier from about 50 to about 350, wherein the spun yarns contain wool fibers in amount from about 15% to about 85% by weight and contain polyester fibers in amount from about 15% to about 85% by weight.

17. A fabric as defined in claim 15, wherein the wool fibers have a diameter of greater than about 18 μm.

18. A garment made from a fabric as defined in claim 15.

19. A garment as defined and claim 18, wherein the garment comprises a uniform.

20. A garment as defined in claim 18, wherein the fabric has been piece dyed or wherein certain fibers contained in the garment have been top dyed or wherein at least certain yarns contained within the garment have been packaged dyed.

* * * * *